US007740543B2

(12) United States Patent
Johne

(10) Patent No.: US 7,740,543 B2
(45) Date of Patent: Jun. 22, 2010

(54) PNEUMATICALLY POWERED BILLIARD CUE STICK

(76) Inventor: Bruce Kevin Johne, 13 8th St., St Augustine, FL (US) 32080

( * ) Notice: Subject to any disclaimer, the term of this patent is extended or adjusted under 35 U.S.C. 154(b) by 0 days.

(21) Appl. No.: 12/232,483

(22) Filed: Sep. 18, 2008

(65) Prior Publication Data

US 2009/0075742 A1 Mar. 19, 2009

Related U.S. Application Data

(60) Provisional application No. 60/973,346, filed on Sep. 18, 2007.

(51) Int. Cl.
*A63D 15/08* (2006.01)

(52) U.S. Cl. ..... 473/45; 473/46

(58) Field of Classification Search ..... 473/44–51; 124/56–77

See application file for complete search history.

(56) References Cited

U.S. PATENT DOCUMENTS 684,290 A * 10/1901 McClain ..... 473/45
788,910 A 5/1905 Jones
1,062,816 A * 5/1913 Burwell ..... 473/45
1,279,925 A * 9/1918 Smith ..... 473/45
3,495,826 A 2/1970 Mizgala
3,858,882 A 1/1975 Fox et al.
4,526,370 A 7/1985 Mortellacci
4,634,123 A 1/1987 Cowan et al.
5,181,718 A 1/1993 Valentine

* cited by examiner

*Primary Examiner*—Mark S Graham

(57) ABSTRACT

Various embodiments of a pneumatically powered cue stick are disclosed. Both embodiments employ the use of compressed gas to derive the full range of power necessary to engage in the various games of pool and billiards, including the break shot, without the need for modification of surface area of the game table. The preferred embodiment is adaptable to existing forms of metering, triggering, portable compressed gas dispensing devices such as, but not limited to, paintball marker guns. An alternative embodiment integrates the metering, triggering, and gas dispensing components of the adaptable type, eliminating the need for the separate, adaptable devices previously mentioned. Both embodiments incorporate a cylinder assembly 14 and a cue stick rod 12 threadably, or otherwise attached, slidably mounted within a support casement 10, to facilitate a predetermined length not unlike, but not limited to, that of a conventional cue stick. Both embodiments are suitable for one-handed operation.

6 Claims, 3 Drawing Sheets

PNEUMATICALLY POWERED BILLIARD CUE STICK

RELATED APPLICATIONS

The present application is a continuation-in-part application of U.S. provisional patent application, Ser. No. 60/973,346, filed Sep. 18, 2007, for PNEUMATICALLY POWERED BILLIARD CUE STICK, by Bruce Kevin Johne, included by reference herein and for which benefit of the priority date is hereby claimed.

FIELD OF THE INVENTION

This application relates to billiard cue sticks and, more particularly, pertains to a new and improved billiard cue stick wherein the same is arranged for actuation and projection through the use of gas under pressure.

BACKGROUND OF THE INVENTION

The traditional cue stick for use in games such as pool, billiards, snooker, etc., is an elongated, single or two piece unit held in both hands. One hand supports the front portion of the cue stick while guiding the ball-striking end, or tip, of the cue stick. The other hand grasping the rear portion, or butt end of the cue stick.

To strike the object ball the user typically pulls the cue stick in a rearward motion with the hand that is grasping the butt end of the cue stick and then pushes the cue stick in a forward motion as to engage the front end, or tip, of the cue stick with the object ball. The front portion of the cue stick is supported and guided by the other hand so that the ball-striking tip of the cue stick will strikes the object ball on a predetermined area, or spot, of the object ball. Furthermore, the front portion of the cue stick must slide freely over the supporting hand and/or through the fingers of the supporting hand to provide accurate guidance for the striking tip. This process is generally referred to as a pool or billiard "shot."

There are two steps involved in accomplishing the desired result in a pool shot. First, the user must visualize the shot with the end result in mind. Second, the user must strike the ball precisely on the predetermined spot of the object ball in order to produce the desired result. This application relates to solving the problems inherent in the second step of the pool or billiard shot. After the user completes the first step of visualizing the shot, the second step requires the user to precisely coordinate the tasks required of both hands and arms in order to strike the ball on the predetermined area, or spot.

After the user grasps the cue stick he/she bends over as to rest one hand on the table supporting the front of the cue stick while grasping the butt end with the other hand. Problems arise when the user performs the task of moving the cue stick back and forth to strike the ball. For all but the very practiced, it is difficult to produce a perfect, piston like motion at the cue stick tip. It is desirable that the piston motion not deviate from the longitudinal axis of the cue stick in order to strike the object ball on the predetermined spot. This perfect piston motion is crucial in accomplishing the desired end result. Furthermore, problems arise with the supporting hand when moving the cue stick back and forth on the surface of the hand and/or through the fingers of the hand. The hand must be completely free of moisture wherever the cue stick comes in contact with the skin. If not, the cue stick will not slide freely across the surface and/or through the fingers of the hand. This free-sliding action is essential for a successful end result. Also, the traditional cue stick does not lend itself to one-handed operation.

The embodiments described in this application eliminate the problems associated with the second step of the shot, as discussed above.

Several patents disclose cue sticks with varying degrees of automation. By and large, these patents disclose variations of complex mechanical devices in various embodiments combining forwardly biased springs, cocking and locking mechanisms, and triggered releasing devices for actuating the cue stick forward to strike a billiard ball. Prior art utilizations of these mechanisms in various embodiments are cited in U.S. Pat. No. 3,495,826 to J. F. Mizgala; U.S. Pat. No. 3,858,882 to Fox et al.; U.S. Pat. No. 4,526,370 to Mortellacci; U.S. Pat. No. 4,634,123 Cowan et al.; U.S. Pat. No. 5,181,718 to Valentine.

U.S. Pat. No. 788,910 to C. S. Jones, discloses a cue stick that is actuated by means of low pressure air. The claimed embodiment describes a cue stick miniature in proportion to a traditional cue stick, and is operated by using both hands; one hand holding the miniature cue stick body, and the other hand squeezing an air bulb to create low pressure air flow through a tube running between the bulb and the cue stick. The air flow is channeled from the bulb through the tube into the rear end of the cue stick whereby actuating a piston inside a cylinder in a forward motion. A piston rod is arranged forwardly so that when the air flow engages the piston, the rod is extended forward through the front end of the cylinder impacting the subject ball.

The complexities associated with the mechanized, spring loaded cue sticks, while solving some of the problems associated with traditional cue sticks, create various and significant obstacles regarding performance and manufacturing. Embodiments of the prior art are, by and large, designed for two-handed operation involving one or more preparatory tasks, prior to operation. A task common to the spring-loaded cue stick involves the compression of the spring and locking a portion of the cue stick into position, whereby forward potential energy is stored in the compressed spring. Generally, in these embodiments, this is referred to as "cocking" the cue stick. Ideally, cocking requires both hands to accomplish the task. This task also requires additional time and effort creating an inconvenience for the user.

Spring-loaded cue sticks, while solving some of the problems associated with traditional cue sticks, typically employ complex combinations of parts, both moving and stationary. This presents significant production design challenges creating proportionately high cost of manufacture and low margins of return on investment, whereby, inhibiting market feasibility.

A demonstration of a refined, spring-loaded embodiment, may be viewed on the YouTube Internet site and is identified as the HOTSHOTS cue stick(inventor unknown). When examined carefully, this demonstration clearly reveals performance challenges facing designers and builders of spring-loaded cue stick embodiments. In the one scene of the video that shows the cue stick verifiably performing the break shot, where as all of the balls are gathered at one end of the table in a triangle shape and are subsequently scattered by the cue ball placed at the opposite end of the game table, demonstrates a shortage of striking power sufficient to effectively scatter the balls in a desirable fashion. Spring(s) with the capability to store the amount of energy necessary to supply the spring-loaded cue stick with ample power to perform the break shot may be disproportionately large and/or difficult to compress when cocking. The remedies for this deficiency may be impracticable, rendering the spring-loaded cue stick ineffective in practice.

The air powered embodiment of a Billiard Cue disclosed in U.S. Pat. No. 788,910 to C. S. Jones, reveals significant design deficiencies in physical size, appearance, and, most importantly, practical functionality. Billiard-type game balls are dense in nature and require a substantial amount of kinetic energy to propel them in a way sufficient to satisfy the standards of play. The squeeze bulb design in this embodiment falls far short of satisfying this standard. Recognizing this shortcoming the disclosure suggests using a miniature game table shrunk to the scale proportionate to the limited ability of the cue stick to propel the ball effectively on a conventionally sized game table. As shrinking the scale of the game provides for a theoretical fix for a power cue stick with limited capabilities, problems arise as result of diminished game surface area. In terms of scale, the smaller the surface area becomes, the larger the balls become. This embodiment is limited such that the game surface would be inadequate for practical play. The proportion of game surface area to game ball size makes this theoretical fix impracticable.

As demonstrated by this applications' embodiments, an effective pneumatically powered cue stick can be totally portable, aesthetically appealing, exceptionally powerful, and can be easily manufactured in large quantities. Operation is fully automatic and requires no cocking, whereby lending itself to convenient, one-handed operation. These embodiments require no adjustments to to scale of current pool and billiards surface area standards and are capable of the full range of striking requirements encountered throughout the game, including impressive ability to scatter balls on the initial break.

SUMMARY OF THE INVENTION

In view of the foregoing disadvantages inherent in the known types of billiard cue stick apparatus now present in the prior art, this application discloses various embodiments of a pneumatically powered billiard cue stick. Each embodiment enables the user to operate same through the full range of ball striking forces that are desired, and necessary to effectively participate and/or compete in the various games of pool and billiards The embodiments disclosed are similar in shape and dimension, but are not limited to, that of traditional billiard cue sticks. As such, the general purpose of the present embodiments, which will be described subsequently in greater detail, is to provide a new and improved billiard cue stick apparatus which has all the advantages of the prior art billiard cue stick apparatus and none of the disadvantages.

To attain this, the current embodiment's use a metered, triggerable, compact, portable, high-pressure compressed air or gas system. The system delivers a high-pressure burst of compressed air or gas to a chamber internally mounted along the longitudinal axis of the cue cue stick. A rod, internally mounted and slideable along the longitudinal axis of the cue stick, is propelled forward. As a result, the tip of the rod is extended out of the front end of the cue stick as to engage a billiard or pool ball propelling same forward. The rod is rearwardly spring-biased, whereby, automatically retracting the rod.

There has thus been outlined, rather broadly, the more important features of the disclosed embodiments in order that the detailed description thereof that follows may be better understood, and in order that the present contribution to the art may be better appreciated. There are, of course additional features of the embodiments that will be described hereinafter and which will form the subject matter of the claims appended hereto.

It is therefore the object of the embodiments disclosed in this application to provide a new and improved, pneumatically powered, billiard cue stick.

It is another object to provide a pneumatically powered billiard cue stick which is automatically engaged by means of a triggering device.

It is another object to provide a pneumatically powered billiard cue stick with sufficient power to satisfy the striking force requirements associated with billiards and pool, including the "break" shot, where as the balls are adequately scattered about the table surface.

It is another object to provide a pneumatically powered cue stick that is, in one embodiment, readily adaptable to existing metering and triggering technology for compressed air and or gas, such as a paintball marker gun. In another embodiment the compressed air or gas triggering and metering device is integral to the cue stick, as well as provisions for adaptability to, and containment of, a compressed air or gas storage bottle.

Further, it is an object of the various embodiments of a pneumatically powered cue stick to be completely operable with on hand, and eliminating the need to manipulate the cue stick back and forth to effect a billiard shot

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
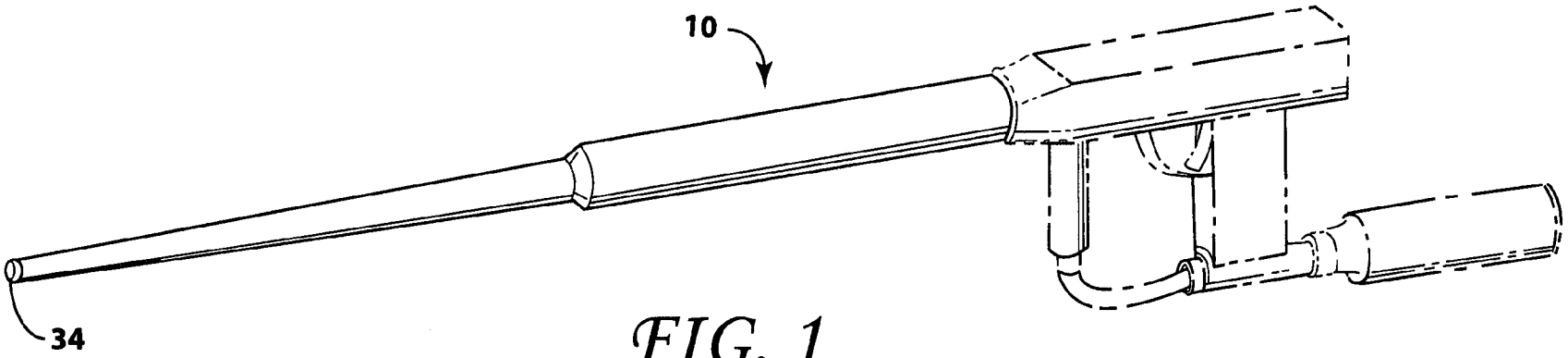
FIG. 1 is a perspective view of the preferred embodiment of the pneumatically powered cue stick invention.

FIG. 1 is a perspective view of the preferred embodiment of the pneumatically powered cue stick invention.

Figure 2:
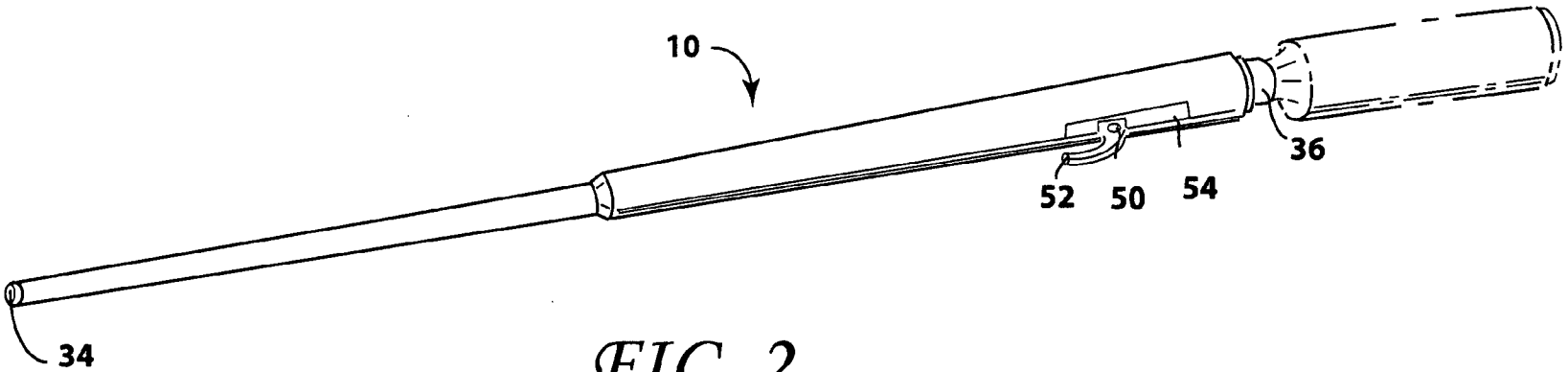
FIG. 2 is a perspective view of an alternative embodiment of the pneumatically powered cue stick invention.

FIG. 2 is a perspective view of an alternative embodiment of the pneumatically powered cue stick invention.

Figure 3:
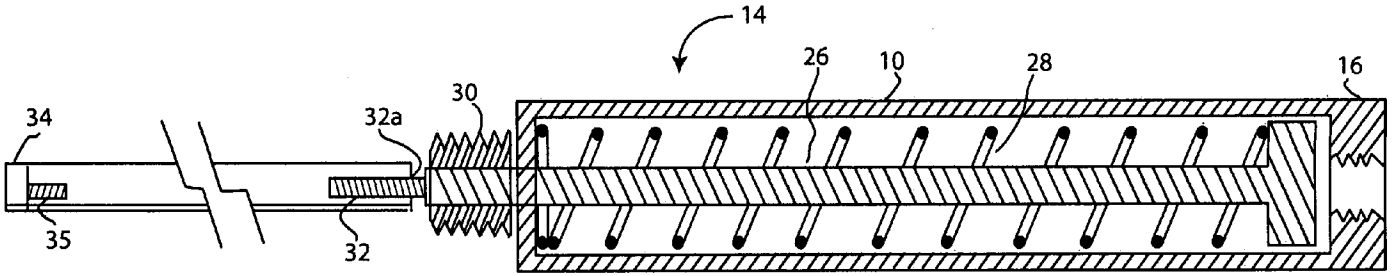
FIG. 3 is a side, cross-sectional view of a pneumatic cylinder assembly contained in both embodiments of the pneumatically powered cue stick invention.

FIG. 3 is a side, cross-sectional view of a pneumatic cylinder assembly 14 contained in both embodiments of the pneumatically powered cue stick invention.

Figure 4A:
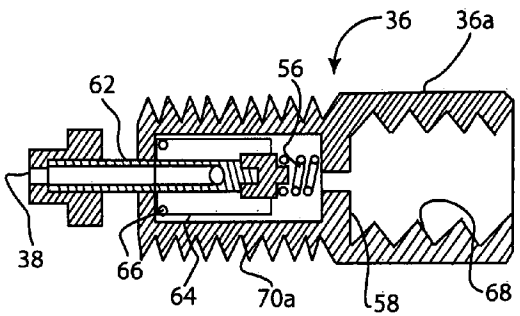
FIG. 4*a* is a side, cross-sectional view of a gas valve assembly in the alternative embodiment of my invention.
Figure 4:
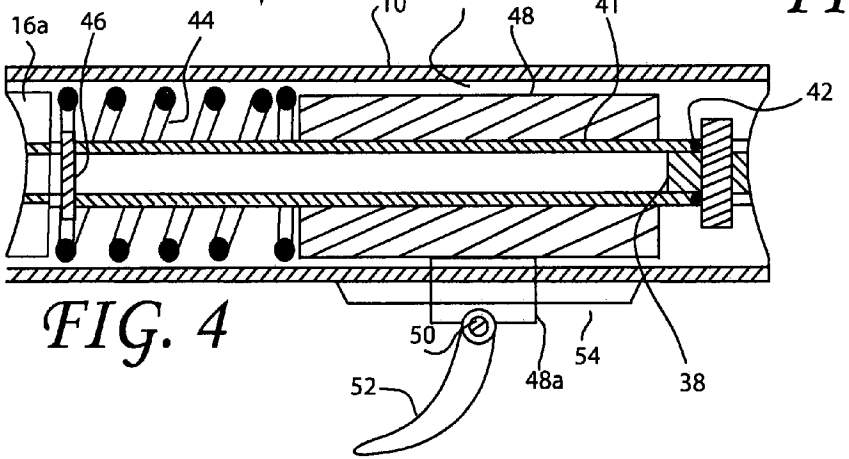
FIG. 4 is a side, cross-sectional view of a triggering mechanism contained in the alternative embodiment of the pneumatically powered cue stick invention.

FIG. 4 is a side, cross-sectional view of a triggering mechanism 40 contained in the alternative embodiment of the pneumatically powered cue stick invention.

Figure 3A:
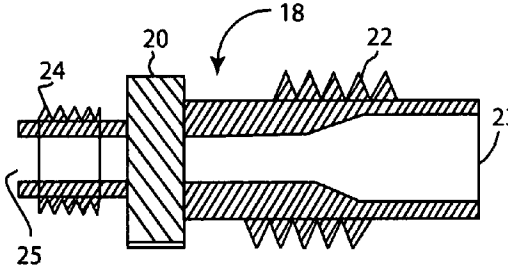
FIG. 3*a* is a side, cross-sectional view of an external air source adaptor in the preferred embodiment of the pneumatically powered cue stick invention.

FIG. 3*a* is a side, cutaway view of an adaptor for external gas source 18 in the preferred embodiment of the pneumatically powered cue stick invention.

FIG. 4*a* is a side, cross-sectional view of a high-pressure gas valve assembly 36 in the alternative embodiment of my invention.

Figure 1A:
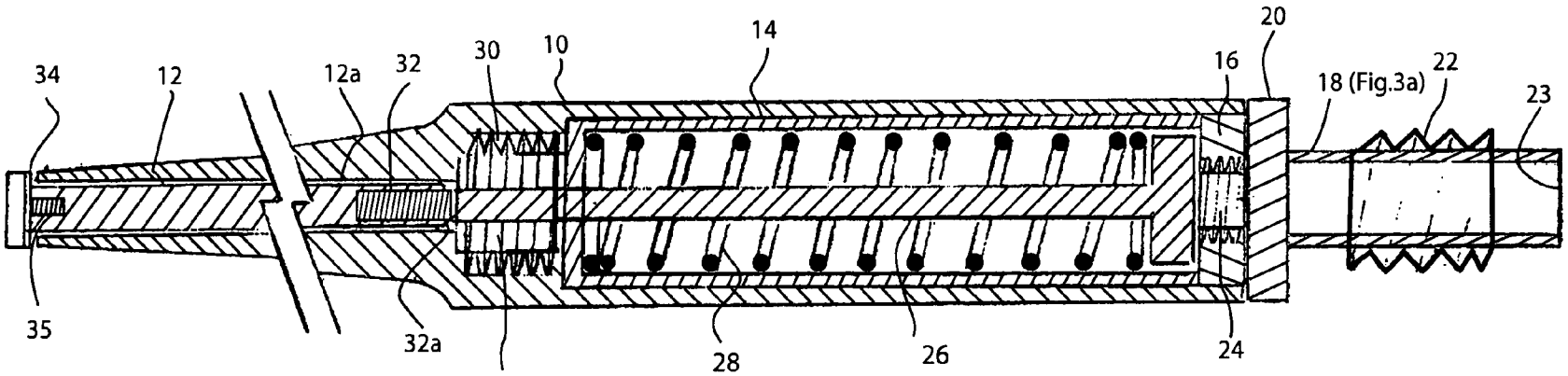
FIG. 1*a* is a side, partially-cross-sectional view of the internals of the preferred embodiment of the pneumatically powered cue stick invention of FIG. 1.

FIG. 1*a* is a side, partially-cross-sectional view of the internals of the preferred embodiment of the pneumatically powered cue stick invention of FIG. 1.

Figure 2A:
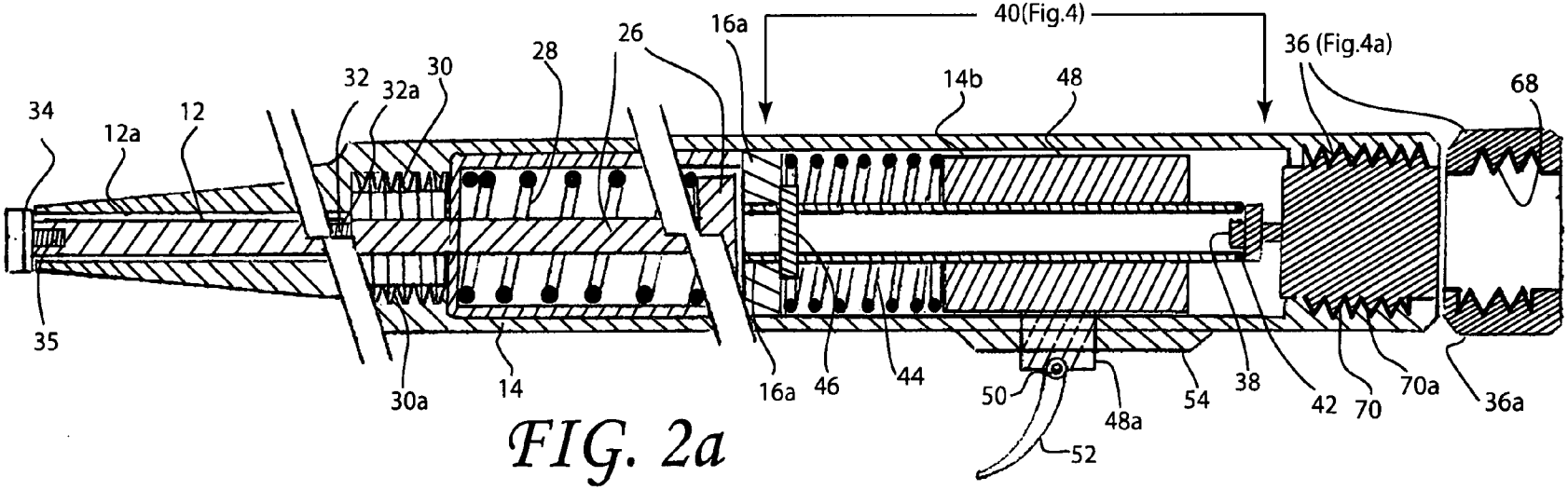
FIG. 2*a* is a side, partially-cross-sectional view of the internals of the alternative embodiment of the pneumatically powered cue stick in FIG. 2.

FIG. 2*a* is a side, partially-cross-section view of of the internals of the alternative embodiment of the pneumatically powered cue stick in FIG. 2.

Referring to the figures there are shown, but not the only, various embodiments of the pneumatically powered cue stick invention. As shown in FIGS. 1 and 2, both embodiments comprise a support casement 10. The support casement 10 is constructed of aluminum round bar bored and machined to specifications necessary for housing and mounting the internal components. However, other materials such as plastic or wood may be used. FIG. 1 shows the preferred embodiment adaptable to an external, metered, triggerable, portable compressed gas dispensing device similar, but not limited to, a paintball marker gun. FIG. 2 shows an alternative embodiment with metering, triggering, gas dispensing components integral to the cue stick, independent of the need for the external gas dispensing device.

For the preferred embodiment, FIG. 1*a* shows the internal components of FIG. 1. A pneumatic cylinder assembly 14 is threadably mounted to a threaded cylinder-nose mounting bore 30*a* inside the support casement 10 through a support casement bore for cylinder 14*a* inside and along the longitudinal axis to of the support casement 10. Integral to the cylinder assembly 14, further illustrated by FIG. 3, is a cylinder piston and rod 26 with a rearwardly-biased spring 28 mounted inside the cylinder between the forward end of the cylinder and the forward face of the cylinder piston and about the piston rod. Protruding forwardly and through a threaded cylinder front nose mount 30 is a threaded piston rod end 32.

A cue stick rod 12 comprises a threaded rod bore 32*a* for attaching the cue stick rod 12 to the threaded piston rod end 32 and forwardly extended from same. The cue stick rod 12 is slideably fitted into a rod bore 12*a* through, and along, the longitudinal axis of the support casement 10. A threadably attached cue stick tip 34 is removeably engaged to the rod end threaded bore for cue stick tip 35. In the preferred embodiment of FIG. 1 the cylinder assembly 14 is rearwardly fitted with a cylinder end cap with threaded port 16. An adaptor for external gas source 18 is threadably attached to the cylinder end cap with threaded port 16. The adaptor for external gas source 18 is locked in place by threadably tightening to the forward limit allowed by an adaptor locking torque plate 20 integral to, and rearward of an adaptor gas exit port 24. The rear, outward end of the adaptor comprises an adaptor gas entry port 23 and threads 22 for removable attachment of the cue stick to the external, metered, triggerable, portable compressed gas dispensing device.

The preferred embodiment of FIGS. 1, 1*a*, 3, and 3*a* show the pneumatically powered cue stick as an adaptable accessory to existing metered, triggerable, portable, gas dispensing devices such as, but not limited to, a paintball marker gun.

In practice, a significant percentage of paintball marker guns comprise a threadably removeable barrel. In FIG. 1 the barrel has been removed and replaced by the preferred embodiment of the pneumatically powered cue stick invention of FIG. 1*a*. Support casement 10 is threadably attached to the paintball marker gun with external threads 22 on adaptor for external gas source 18 and integral to adaptor gas entry port 23. The cue stick is then screwably tightened to the limit allowed by adaptor locking torque plate 20. With a paintball marker gun threadably mated with the cue stick, it is ready for use.

In operation, when the trigger of the paintball marker gun is pulled, a predetermined amount of compressed gas is released forwardly into the adaptor gas entry port 23 subsequently flowing through the adaptor for external gas source 18. The gas then exits through the adaptor gas exit port 24 into the cylinder assembly 14 through the cylinder end cap with threaded port 16. The gas then engages the rear face of the cylinder piston and rod 26 thrusting same forward.

Rearwardly-biased spring 28 mounted inside the cylinder assembly 14 between the forward end of the cylinder and the forward face of the cylinder piston about the piston rod, is instantly compressed, momentarily storing energy. As the cylinder piston and rod 26 are thrust forward through a threaded cylinder front nose mount 30, the cue stick rod 12, comprising a threaded rod bore 32*a*, witch is threadably attached to a threaded piston rod end 32, is slideably thrust forward through rod bore 12*a*. A threadably attached cue stick tip 34, removeably engaged to a rod end threaded bore for cue stick tip 35, is instantly thrust forward out of the forward end of the cue stick support casement 10 forcibly engaging a subject game ball. As a result of the previously mentioned spring compression internal of the cylinder assembly 14, all of the components that are thrust forward are instantly and automatically retracted rearward by the energy stored in the rearwardly biased spring.

As a result of the automatic retraction, the cue stick is immediately ready for another use, independent of any physical effort to cock, or reset the cue stick. Unlike other cue stick inventions of the spring-loaded, cocking type, or the pneumatic cue stick sited in prior art; U.S. Pat. No. 788,910 to Jones, the user can engage the cue stick repeatedly, limited only by the speed at which he or she can pull the trigger, and how much gas exists in reserve. Also, unlike U.S. Pat. No. 788,910 to Jones, the embodiments described in this application are aesthetically conformant to traditional billiard cue sticks and are sufficient in power to use on traditionally sized game tables.

An alternative embodiment of the invention is illustrated in FIG. 2. It is independent of the external, metered, triggering, portable, gas dispensing device of the preferred embodiment of FIG. 1. Instead, the metering and triggering components are integrated into this embodiment of the pneumatically powered cue stick. As shown in FIG. 2*a*, this embodiment comprises the same components of the preferred embodiment of FIGS. 1 and 1*a*, with the addition of other components, illustrated in detail in FIGS. 4 and 4*a*, to perform the tasks of the external gas dispensing device as described in the preferred embodiment. Furthermore, a component of the preferred embodiment, illustrated in FIG. 3*a*, is eliminated in the described alternative embodiment. The addition and elimination of said components is described in context immediately forthcoming.

A support casement 10 for the alternative embodiment is longer than that of the preferred embodiment. In this embodiment the need for the adaptor for external gas source 18 of FIGS. 1*a* and 3*a* has been eliminated. Instead, additional support casement 10 length is provided for inclusion of a support casement bore for triggering mechanism for alternative embodiment 14*b*, and a triggering mechanism 40 integrally mounted in same, as illustrated in FIGS. 2*a*, and 4. Furthermore, located immediately behind the triggering mechanism 40, integral to the support casement bore for triggering mechanism for alternative embodiment 14*b*, are support casement threads 70 for removeably attaching a gas valve assembly 36 as seen in FIGS. 2*a* and 4*a*. The alternative embodiment also includes a modification of the cylinder end cap with threaded port 16 of the preferred embodiment.

In FIGS. 2*a* and 4 a cylinder end cap for alternative embodiment with non-threaded port 16*a* can be observed. This modification is to facilitated slideable, reciprocal movement of a gas conduit 41. The gas conduit 41 is tubular to facilitate the passage of gas from the valve gas port 38 into the cylinder assembly 14 through the cylinder end cap for alternative embodiment with non-threaded port 16*a*. The gas conduit 41 comprises a gas conduit O-ring seal 42 at the point of engagement to the valve gas port 38. Furthermore, the gas conduit 41 steadfastly mounted longitudinally through the center of a slideable triggering cylinder and gas conduit support 48. Additionally, the gas conduit 41 is permanently fitted with a gas conduit forward travel stop ring 46. This stop ring prevents contact between the gas conduit 41 and the rear face of the cylinder piston and rod 26 within the cylinder assembly 14

Internally mounted within the support casement bore for triggering mechanism for alternative embodiment 14*b*, between the forward end of the slideable triggering cylinder and gas conduit support 48 and the rearward end of the cylinder assembly 14, about the gas conduit 41, is a rearwardly biased triggering-assist spring 44. Said spring aiding in a smooth rearward motion of the slideable triggering cylinder and gas conduit support 48 when a trigger lever 52 is pulled rearward as to positively engage the gas conduit 41 with the valve gas port 38. Integral to the trigger lever 52 is a spring-loaded trigger lever mounting hinge 50 which is attached to a trigger lever mounting tab 48*a*. Said mounting tab is integral to the slideable triggering cylinder and gas conduit support 48 and extends outward from the support casement 10 bore through a trigger lever mounting tab guide slot 54. Said guide slot allows for free reciprocal movement of the trigger lever mounting tab 48*a* protruding from the support casement 10 along the longitudinal axis of same.

A gas valve assembly 36 is threadably attached with valve assembly attachment threads 70*a* and mounted at the rear of the support casement 10 into the support casement threads 70. The gas valve assembly 36 is internally threaded at its rear with tank threads 68 as to accept a compressed gas tank. The gas valve assembly 36 comprises a valve frame 36*a*, valve spring 56, valve spring retainer 58, valve plunger 60, valve gas conduit 62, valve seal 64, and valve seal O-ring 66. The function of the components of the gas valve assembly 36 will be discussed in the operational description that follows.

In operation, the alternative embodiment of the pneumatically powered cue stick invention of FIGS. 2 and 2*a* is almost identical to the preferred embodiment of FIGS. 1 and 1*a*. The difference between the two being that the preferred embodiment is adaptable to an external metering, triggerable, portable gas dispensing device while the alternative embodiment comprises said metering, triggering, gas dispensing components within the confines of the support casement 10. A compressed gas tank is then threadably, or otherwise attached to the rear of the support casement 10. Once said tank is attached, the cue stick is ready for use.

As rearward pressure is applied to the trigger lever 52, trigger lever mounting tab 48*a* is moved slideably rearward through and along the longitudinal axis of trigger lever mounting tab guide slot 54. Coincidingly, slideable triggering cylinder and gas conduit support 48 is moved rearward through and along the longitudinal axis of support casement bore for triggering mechanism for alternative embodiment 14*b*. Thusly, the rearward end of gas conduit 41 with gas conduit O-ring seal 42 positively engage valve gas port 38 causing the release of compressed gas from gas valve assembly 36.

The forward end of the gas conduit 41 is slideably engaged to the cylinder assembly 14 and is moved reciprocally through cylinder end cap for alternative embodiment with non-threaded port 16*a* coincidingly with the movement of the triggering mechanism 40. Rearwardly biased triggering-assist spring 44 aids in a smooth rearward motion of triggering mechanism 40 against forwardly spring loaded valve gas port 38. As gas is released it flows instantly through the tubular gas conduit 41 and into cylinder assembly 14 engaging cylinder piston and rod 26 and thrusting same forward. In both embodiments, all of the components forward of the cylinder assembly 14 are identical, in reference number and function, as previously described in the preferred embodiment.

Instantly following the release of gas from valve gas port 38 same is forwardly and sealably forced shut by forwardly biased valve spring 56, stopping the flow of gas. Because the triggering mechanism 40, including gas conduit 41 is communicated with valve gas port 38, the triggering mechanism 40 and gas conduit 41 are thusly and instantly moved forward. As a result of the positive connection between the trigger lever 52, the trigger lever mounting tab 48a, slideable triggering cylinder and gas conduit support 48, and gas conduit 41, all are simultaneously moved instantly forward. To limit the forward travel of the triggering mechanism 40, a gas conduit forward travel stop ring 46 is rigidly attached to the forward end of the gas conduit 41 immediately outside the rear of the cylinder assembly 14. A spring-loaded trigger lever mounting hinge 50 is located, and positively mounted between the trigger lever 52 and the trigger lever mounting tab 48*a*. As the triggering mechanism 40 is forcibly thrust forward immediately following the release of gas the spring-loaded trigger lever mounting hinge 50 allows the triggering mechanism 40 to move forward without forward movement of the trigger lever 52. This component eliminates the discomfort that may be caused as a result of the trigger lever 52 being thrust instantly forward with rearward pulling pressure still being applied by the user.

Reference is directed to FIG. 4*a* which are details of the gas valve assembly 36 in the alternative embodiment. The gas valve assembly 36 is a poppet type valve which is spring biased to a closed position. Said assembly includes a gas valve frame 36*a* which has tank threads 68 for attachment to a compressed gas tank and valve assembly attachment threads 70*a* to engage support casement threads 70. The valve frame 36*a* has a passage formed through which is sized to accept a valve seal 64 that comprises a valve seal O-ring 66 which seals against the loss of compressed gas. A valve plunger 60 engages the valve seal 64 to form the actual gas valve action. The valve plunger 60 is attached to the valve gas conduit 62 which is inter attached to valve gas port 38. These three elements move together when the valve gas port 38 is engaged by gas conduit 41 with gas conduit O-ring seal 42 (not shown). The aforesaid three elements are biased to a closed position by valve spring 56 which rests against valve spring retainer 58 attached to an inlet end of valve frame 36*a*. It should be understood that other valve assemblies may be contemplated for accomplishing the same valve function.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A pneumatically powered billiard cue stick for striking billiard and pool balls associated with the various games relating to billiards and pool comprising:

a support casing for supporting internal components including a cylinder piston and rod assembly;

means for transferring forward energy of the cylinder piston and rod assembly through the length of the support casement to a cue stick tip;

means for providing support and guidance for the cue stick rod and, further, allowing free and reciprocal movement of same;

means for converting gaseous energy to mechanical energy to drive the cue stick rod reciprocally and internally along the longitudinal axis of the support casement, rigidly connected to said means for supporting internal components of the invention; and a portable paintball marker gun for metering and triggering the dispersion of gas under pressure rigidly connected to said support casing.

2. A pneumatically powered billiard cue stick for striking billiard and pool balls associated with the various games relating to billiards and pool, comprising:

a support casement, for supporting internal components;

a cue stick rod, for transferring forward energy of the cylinder piston and rod assembly through the length of the support casement to a cue stick tip;

a rod bore, for providing support and guidance for the cue stick rod and, further, allowing free reciprocal movement of same;

a cylinder assembly, for converting gaseous energy to mechanical energy to drive the cue stick rod reciprocally and internally along the longitudinal axis of the support casement, rigidly connected to said support casement;

an adaptor for an external gas source, for joining the cue stick invention to an external, metering, triggering, portable gas dispensing apparatus such as a paintball marker gun, rigidly connected to said support casement; and a gas valve assembly, for containment and delivery of a predetermined amount of compressed gas rigidly connected to said support casement.

3. A pneumatically powered billiard cue stick for striking billiard and pool balls associated with the various games relating to billiards and pool, comprising:

a support casement, for supporting internal components;

a cue stick rod, for transferring forward energy of the cylinder piston and rod assembly through the length of the support casement to a cue stick tip;

a rod bore, for providing support and guidance for the cue stick rod and, further, allowing free reciprocal movement of same;

a cylinder assembly, for converting gaseous energy to mechanical energy to drive the cue stick rod reciprocally and internally along the longitudinal axis of the support casement, rigidly connected to said support casement;

an adaptor for an external gas source, for joining the cue stick invention to an external, metering, triggering, portable gas dispensing apparatus such as a paintball marker gun, rigidly connected to said support casement; and a triggering mechanism, for activating the release of compressed gas through a gas valve assembly, sealably coupled to said gas valve assembly, and sequentially housed to said support casement.

4. A pneumatically powered billiard cue stick for striking billiard and pool balls associated with the various games relating to billiards and pool, comprising:

a support casement, for supporting internal components;

a cue stick rod, for transferring forward energy of the cylinder piston and rod assembly through the length of the support casement to a cue stick tip;

a rod bore, for providing support and guidance for the cue stick rod and, further, allowing free reciprocal movement of same;

a cylinder assembly, for converting gaseous energy to mechanical energy to drive the cue stick rod reciprocally and internally along the longitudinal axis of the support casement, rigidly connected to said support casement;

an adaptor for an external gas source, for joining the cue stick invention to an external, metering, triggering, portable gas dispensing apparatus such as a paintball marker gun, rigidly connected to said support casement;

a rearwardly-biased spring, for automatically retracting the cue stick rod immediately following deployment of same and;

a gas valve assembly, for containment and delivery of a predetermined amount of compressed gas, sealably coupled to said triggering mechanism, and rigidly connected to said support casement.

5. A pneumatically powered billiard cue stick for striking billiard and pool balls associated with the various games relating to billiards and pool, comprising:

a support casement, for supporting internal components;

a cue stick rod, for transferring forward energy of the cylinder piston and rod assembly through the length of the support casement to a cue stick tip;

a rod bore, for providing support and guidance for the cue stick rod and, further, allowing free reciprocal movement of same;

a cylinder assembly, for converting gaseous energy to mechanical energy to drive the cue stick rod reciprocally and internally along the longitudinal axis of the support casement, rigidly connected to said support casement;

an adaptor for an external gas source, for joining the cue stick invention to an external, metering, triggering, portable gas dispensing apparatus such as a paintball marker gun, rigidly connected to said support casement;

a rearwardly-biased spring, for automatically retracting the cue stick rod immediately following deployment of same and;

a gas valve assembly, for containment and delivery of a predetermined amount of compressed gas, sealably coupled to said triggering mechanism, and rigidly connected to said support casement, a triggering mechanism, for activating the release of compressed gas through the gas valve assembly sealably coupled to said gas valve assembly, and sequentially housed to said support casement.

6. A pneumatically powered billiard cue stick for striking billiard and pool balls associated with the various games relating to billiards and pool, comprising:

a support casement, for supporting internal components of the invention including a cylinder piston and rod assembly;

a cue stick rod, for transferring forward energy of the cylinder piston and rod assembly through the length of the support casement to a cue stick tip;

a rod bore, for providing support and guidance for the cue stick rod and, further, allowing free reciprocal movement of same;

a cylinder assembly, for converting gaseous energy to mechanical energy to drive the cue stick rod reciprocally and internally along the longitudinal axis of the support casement, rigidly connected to said support casement;

an adaptor for external gas source, for joining the cue stick invention to an external, metering, triggering, portable gas dispensing apparatus such as a paintball marker gun, rigidly connected to said support casement;

a rearwardly-biased spring, for automatically retracting the cue stick rod immediately following deployment of same;

a gas valve assembly, for containment and delivery of a predetermined amount of compressed gas in the alternative embodiment, rigidly connected to said support casement; and a triggering mechanism, for activating the release of compressed gas through the gas valve assembly in the alternative embodiment, sealably coupled to said gas valve assembly, and sequentially housed to said support casement.

* * * * *